US008469187B2

(12) United States Patent
Wattenbarger et al.

(10) Patent No.: US 8,469,187 B2
(45) Date of Patent: Jun. 25, 2013

(54) WATERTIGHT STRETCH COVERING SKIN FOR SMOKELESS TOBACCO CANS

(76) Inventors: Joseph Clay Wattenbarger, Bakersfield, CA (US); Thomas Lance Osborne, Bakersfield, CA (US)

( * ) Notice: Subject to any disclaimer, the term of this patent is extended or adjusted under 35 U.S.C. 154(b) by 0 days.

(21) Appl. No.: 13/009,842

(22) Filed: Jan. 19, 2011

(65) Prior Publication Data

US 2012/0247986 A1 Oct. 4, 2012

(51) Int. Cl.
*B65D 85/10* (2006.01)

(52) U.S. Cl.
USPC ..... 206/242; 206/497

(58) Field of Classification Search
USPC ..... 206/497, 242, 247, 260, 269; 229/87.02, 229/87.14, 87.01; 150/154, 165
See application file for complete search history.

(56) References Cited

U.S. PATENT DOCUMENTS

| | | | | |
|---|---|---|---|---|
| D263,767 | S | 4/1982 | Sogoian et al. | |
| D271,061 | S | 10/1983 | Zimmerman | |
| 4,562,620 | A | 1/1986 | Oliver, Jr. | |
| D283,076 | S | 3/1986 | States, Jr. | |
| 4,584,718 | A * | 4/1986 | Fuller | 455/351 |
| D291,389 | S | 8/1987 | Crymes | |
| D387,897 | S | 12/1997 | Yorke et al. | |
| 5,752,599 | A | 5/1998 | Veltman | |
| 6,305,538 | B1 * | 10/2001 | Jackson | 206/316.3 |
| D483,939 | S | 12/2003 | Kountz et al. | |
| D548,957 | S | 8/2007 | Lowe | |
| D559,531 | S | 1/2008 | Koppe | |
| D595,953 | S | 7/2009 | Collins | |
| D595,954 | S | 7/2009 | Collins | |
| D595,955 | S | 7/2009 | Collins | |
| D595,956 | S | 7/2009 | Collins | |
| D597,300 | S | 8/2009 | Collins | |
| D597,737 | S | 8/2009 | Collins | |
| D600,006 | S | 9/2009 | Lau | |
| D650,269 | S | 12/2011 | Berggren | |
| 8,204,561 | B2 * | 6/2012 | Mongan et al. | 455/575.8 |
| 2002/0175195 | A1 | 11/2002 | Cole | |
| 2005/0016878 | A1 * | 1/2005 | Bergus et al. | 206/307 |
| 2006/0060480 | A1 | 3/2006 | Budd | |
| 2006/0231448 | A1 * | 10/2006 | Clough | 206/494 |
| 2008/0047967 | A1 * | 2/2008 | Brunner et al. | 220/737 |
| 2009/0014343 | A1 * | 1/2009 | Clark et al. | 206/247 |
| 2009/0041581 | A1 * | 2/2009 | Foxworth | 416/62 |
| 2009/0057257 | A1 * | 3/2009 | Marcus et al. | 215/11.6 |
| 2009/0183807 | A1 * | 7/2009 | Sadlier | 150/154 |
| 2010/0122756 | A1 * | 5/2010 | Longinotti-Buitoni | 150/165 |
| 2010/0206320 | A1 | 8/2010 | Hodgson et al. | |
| 2010/0294405 | A1 * | 11/2010 | Longinotti-Buitoni | 150/165 |
| 2011/0000805 | A1 * | 1/2011 | Ho | 206/320 |
| 2011/0005648 | A1 * | 1/2011 | Sa | 150/154 |
| 2011/0017620 | A1 * | 1/2011 | Latchford et al. | 206/320 |

FOREIGN PATENT DOCUMENTS

| | | |
|---|---|---|
| FR | 2745276 | 8/1997 |

* cited by examiner

*Primary Examiner* — Jacob K Ackun
(74) *Attorney, Agent, or Firm* — Mark D. Miller

(57) ABSTRACT

A low profile silicone elastic molded covering skin form fits and seals around a smokeless tobacco container. A molded in circular sealing ring seals around the metal top of the container. The sealed top around the metal cover of the container and watertight bottom prevent air and moisture from contacting the tobacco through the bottom porous portion of the container and between the metal cover and the bottom.

8 Claims, 4 Drawing Sheets

WATERTIGHT STRETCH COVERING SKIN FOR SMOKELESS TOBACCO CANS

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to special receptacles for tobacco products and particularly to a low-profile waterproof and flexible rubberized housing skin for covering and protecting a smokeless tobacco can; the flexible waterproof covering provides an opening at the top through which the user inserts a smokeless tobacco can (chewing tobacco or snuff), the tight fit of the cover allows consumers to submerge a can of smokeless tobacco in a liquid without their tobacco becoming ruined.

2. Description of Related Art Including Information Disclosed Under 37 CFR 1.97 And 1.98

The chewing tobacco container has a cardboard or plastic bottom and metal cap or top. The tobacco goes bad due to prolonged exposure to the environment. Also the cardboard bottom can get wet and spoil the chewing tobacco. The prior art smokeless tobacco containers fail to form a watertight cover around the bottom cardboard area of the smokeless tobacco container and fail to form a watertight seal with the metal top of the smokeless tobacco container to prevent liquid and moisture from seeping down onto the bottom of the smokeless tobacco container.

U.S. Patent Application No. 20020175195, published Nov. 28, 2002 by Cole, is for a holder for a container of smokeless tobacco. The holder provides a vehicle for advertising and can be removably attached to a automobile visor, belt or waistband, golf cart or the like. In its preferred form, the holder is a semi-cylindrical frame with an open top and side. In this way, the inner and outer surfaces of the side wall, as well as the inner surface of the back wall, are visible when the container is not in the holder. When the container is in the holder, the outer side wall is still visible. These visible surfaces are ideal as display surfaces for advertising indicia, which can relate to the brand of smokeless tobacco or to any other advertising subject matter. The holder is inexpensive and can be provided as an advertising "give-away" or sold with the smokeless tobacco as a promotional item.

U.S. Pat. No. 5,752,599, issued May 19, 1998 to Veltman, is for a can holder for use with a can of smokeless tobacco. The apparatus comprises a threaded container for receiving and securing a can of smokeless tobacco. A mirror is connected to the underside of the container to assist a smokeless tobacco user in determining whether or not tobacco particles have become lodged or are adhering to their teeth. A toothpick removably retained within a toothpick housing assists a smokeless tobacco user in removing any detected tobacco particles.

U.S. Pat. No. 4,562,620, issued Jan. 7, 1986 to Oliver, Jr., claims a belt buckle for holding a can of smokeless tobacco which includes a plate for attachment to a belt and a clasp to join the ends of the belt. A cylindrically-shaped recess is formed in the plate which has a diameter slightly larger than the can of smokeless tobacco, and three lugs are mounted on the plate adjacent to the recess adjacent the lower 180.degree. portion of the recess. The can is inserted in a downward direction into the recess between the recess and the lugs. The recess and the lugs act cooperatively to compress and flex the can of smokeless tobacco during insertion and a locking action is effected on the can of smokeless tobacco when the can returns to its original configuration when disposed within the recess.

U.S. Pat. No. D600,006, issued Sep. 15, 2009 to Lau, provides the ornamental design for a tobacco chew case.

U.S. Pat. No. D483,939, issued Dec. 23, 2003 to Kountz et al, shows the ornamental design of a container.

U.S. Pat. No. D263,767, issued Apr. 13, 1982 to Sogoian et al, describes the ornamental design for a holder for a chewing tobacco pouch or the like.

U.S. Pat. No. D291,389, issued Aug. 18, 1987 to Crymes, discloses the ornamental design for a snuff box holder.

U.S. Pat. No. D271,061, issued Oct. 25, 1983 to Zimmerman, indicates the ornamental design for a combined belt buckle and snuff box holder.

U.S. Pat. No. D283,076, issued Mar. 25, 1986 to States, Jr., puts forth the ornamental design for a chewing tobacco can holder.

Six U.S. Pat. Nos. D597,737 issued Aug. 11, 2009; D597,300 issued Aug. 4, 2009; D595,956; D595,955; D595,954 and D595,953 issued Jul. 14, 2009 to Collins, concern the ornamental designs for a smokeless tobacco container holder.

U.S. Pat. No. D559,531, issued Jan. 15, 2008 to Koppe, illustrates the ornamental design for a case for a tobacco tin.

U.S. Pat. No. D548,957, issued Aug. 21, 2007 to Lowe, is for the ornamental design for a tobacco holder.

U.S. Pat. No. D387,897, issued Dec. 23, 1997 to Yorke et al, provides the ornamental design for the smokeless tobacco can holder.

What is needed is a form fitting container for smokeless tobacco containers which has a watertight cover around the bottom area of the smokeless tobacco container and a skin tight form fitting top portion to form a watertight seal with the metal top of the smokeless tobacco container to prevent liquid and moisture from seeping down onto the bottom of the smokeless tobacco container thereby preventing spoiling of the tobacco in the container from air or moisture exposure through the bottom portion of the smokeless tobacco container or between the metal top and the bottom of the container.

BRIEF SUMMARY OF THE INVENTION

An object of the present invention is to provide a form fitting removable skin cover for smokeless tobacco containers which has a watertight bottom portion around the bottom area of the smokeless tobacco container and a skin tight form fitting top portion having a molded in sealing ring around the inside of the skin cover to form a watertight seal with the metal top of the smokeless tobacco container to prevent air, liquid, and moisture from seeping down onto the bottom of the smokeless tobacco container thereby preventing spoiling of the tobacco in the container from air or moisture exposure through the bottom portion of the smokeless tobacco container or between the metal top and the bottom of the container.

A related object of the present invention is to provide a center opening in the top fitting tightly against the top of the can to form a seal, but easily lifted and stretched to install or remove a smokeless tobacco container and to gain access to the tobacco by opening the metal top of the smokeless tobacco container.

Another object of the present invention is to provide a highly elastic high friction clinging upper portion to seal around the metal top of the smokeless tobacco container and a waterproof smooth low friction bottom portion so that the present invention slides easily into and out of a pocket or other storage space.

In brief, the present invention provides a low profile silicone like molded housing with an elastic type characteristic to form fit a smokeless tobacco container. The present invention is molded and made to the same measurements as a smokeless tobacco can to assure the tightest seal possible. The present invention provides molded material that will be fitted on the bottom and sides with a cover sealing circular sealing ring on top which will be applying pressure while still being able to be removed easily.

The surfaces of the present invention provide for a wide variety of options including color, design, custom logos/names, and sports logos or other licensed images.

A molded circular seal between the top and the side of the skin housing of the present invention mates with the shape of the smokeless tobacco can cover to form a watertight seal with the metal cover of the smokeless tobacco can. The form fitting thin elasticized housing grips the tobacco can with a form fit to seal in the bottom portion of the smokeless tobacco can to prevent water from contacting the bottom of the can and ruining the tobacco and to preserve the tobacco and prolong the useful life of the tobacco and maintain the freshness.

A smooth surface at least on the bottom of the housing skin enables the skin covered smokeless tobacco can to slip in and out of a pocket or carrying bag easily.

The round hole in the top of the housing skin and the highly flexible skin enable easy stretching of the skin housing to install the smokeless tobacco can in the skin housing or remove it therefrom and to allow easy lifting or removal of the smokeless tobacco can cover or removal of the skin from the can for access to the tobacco inside.

The close fitting skin housing on the top of the metal can cover and the internal circular sealing ring prevent liquids from entering through the top skin housing opening to preserve the bottom of the can by providing a waterproof covering and seal.

The present invention allows users to submerge a can of smokeless tobacco in a liquid without their tobacco becoming ruined.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
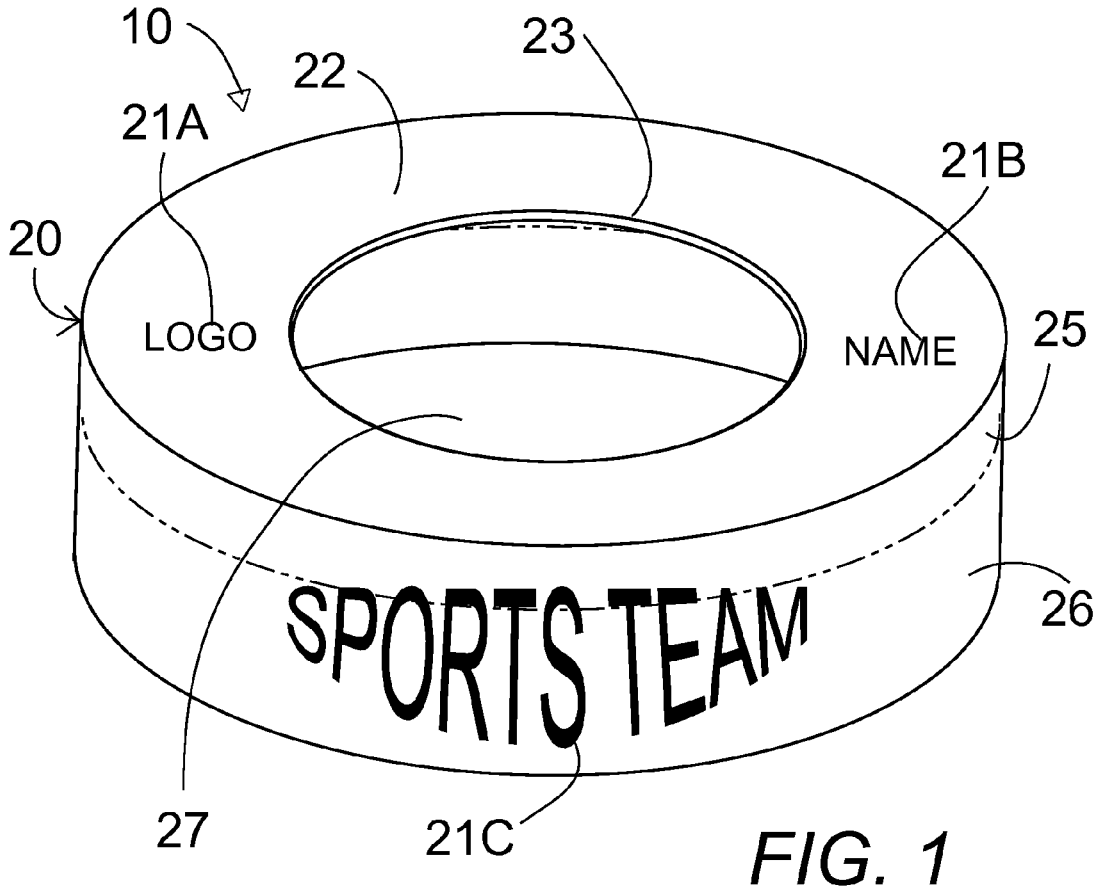
FIG. 1 is a perspective view of an embodiment of a smokeless tobacco container covering skin of the present invention.
Figure 2:
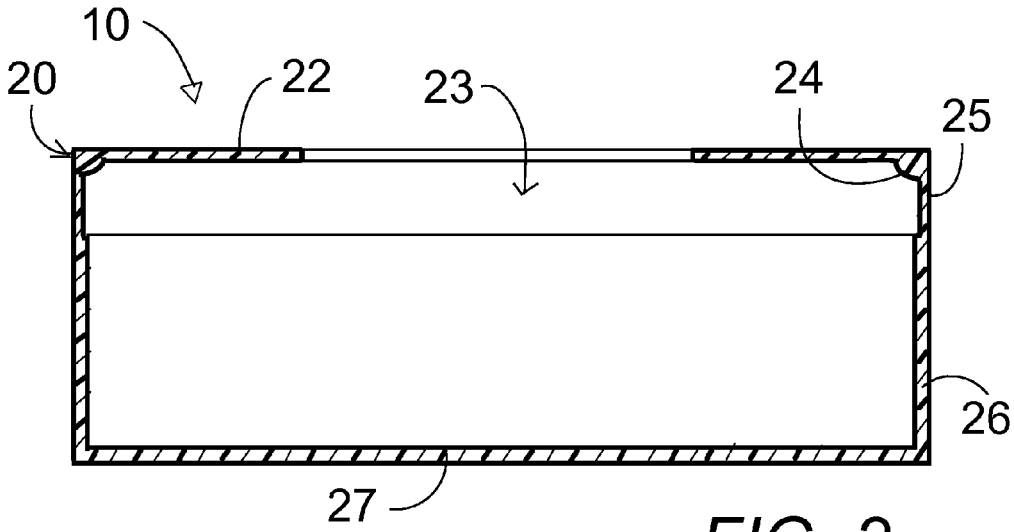
FIG. 2 is a center cross sectional view of the embodiment of FIG. 1 with no smokeless tobacco container inside.
Figure 3:
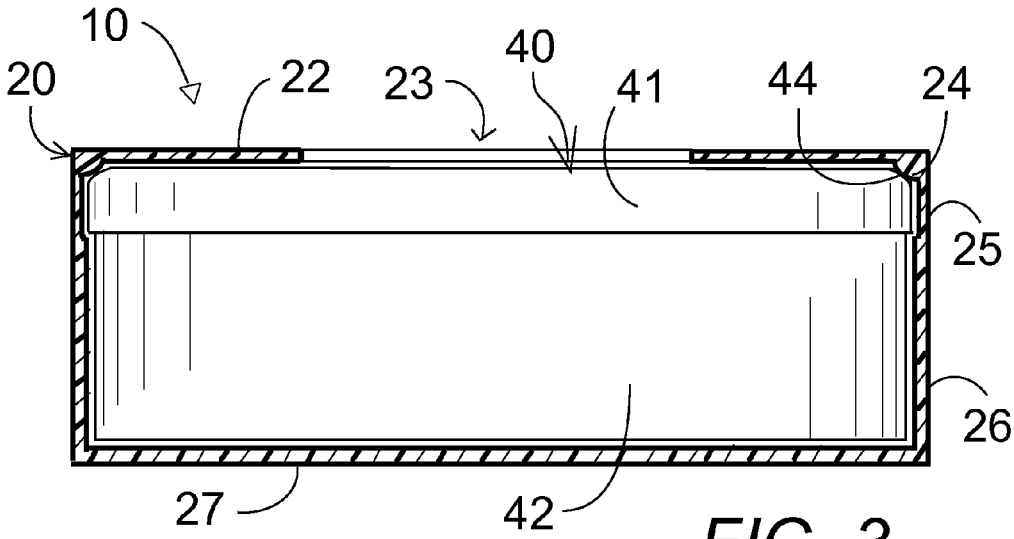
FIG. 3 is a center cross sectional view of the embodiment of FIG. 1 with a smokeless tobacco container inside.
Figure 4:
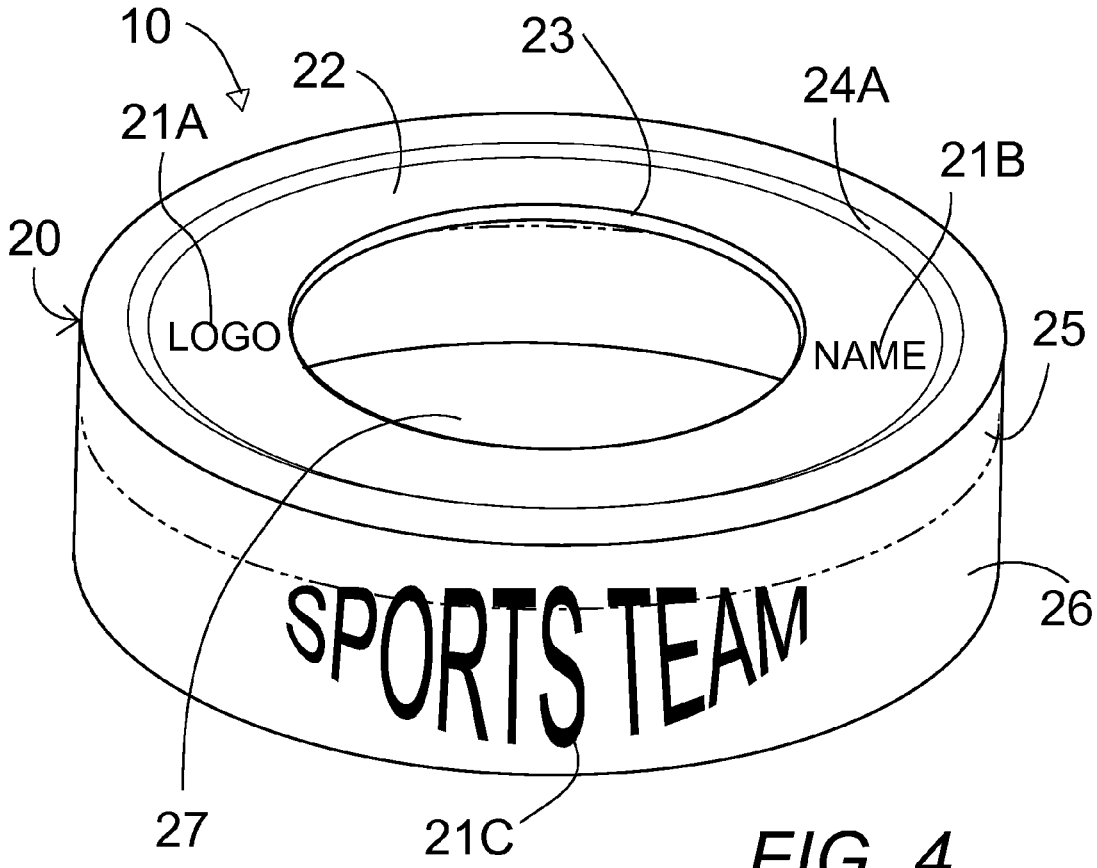
FIG. 4 is a perspective view of an alternative embodiment of a smokeless tobacco container covering skin of the present invention.
Figure 5:
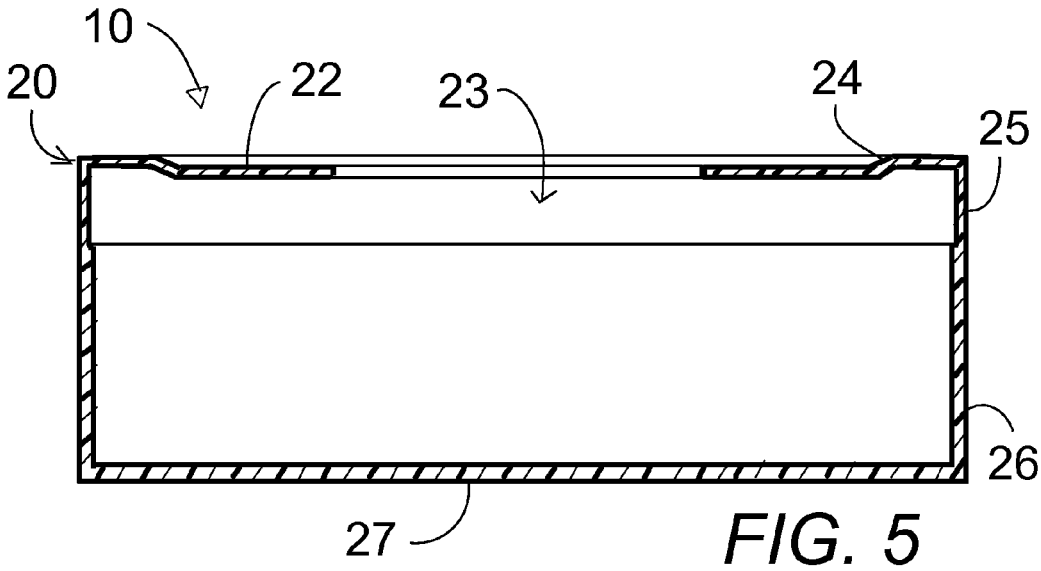
FIG. 5 is a center cross sectional view of the embodiment of FIG. 4 with no smokeless tobacco container inside.
Figure 6:
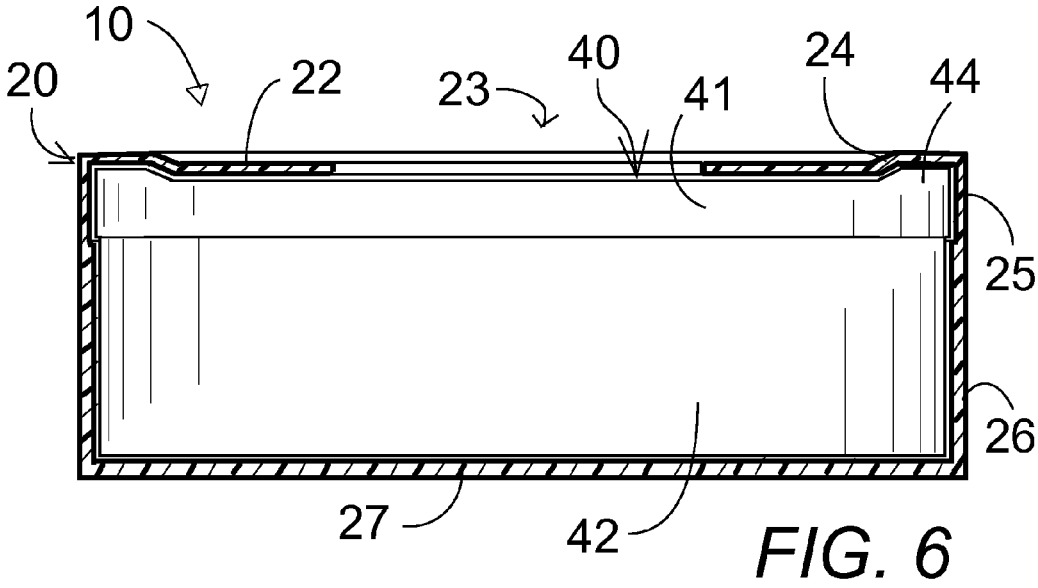
FIG. 6 is a center cross sectional view of the embodiment of FIG. 4 with a smokeless tobacco container inside.

In FIGS. 1-3, a waterproof covering skin device 10 for smokeless tobacco containers, the device comprises a covering skin 20 which encases and grips a smokeless tobacco container 40, as shown in FIG. 3, to prevent air and moisture from contacting the tobacco contents. The covering skin 20 comprises a molded low profile skin of stretchable material having an interior in the shape of the smokeless tobacco container 40 and smaller than the smokeless tobacco container to stretch to conform to the shape of and grip the smokeless tobacco container.

The covering skin 20 has a waterproof bottom portion 26 with a sealed bottom 27 completely surrounding a bottom portion 42 of the smokeless tobacco container 40 below a metal cap 41 on the smokeless tobacco container to prevent air and moisture from contacting the bottom 42 of the smokeless tobacco container. A top portion 25 comprises stretchable molded resilient gripping skin 21 to conform to and grip the metal cap 41 of the smokeless tobacco container and form an air proof and moisture proof barrier therebetween in a first condition, as shown in FIG. 3, to prevent air and moisture from contacting the bottom portion of the smokeless tobacco container.

The top portion 25 has a center opening 23 in the tight top skin 21 clinging to the metal top 41 of the smokeless tobacco container 40 so that the tight skin in a second stretched back condition is stretched away from contact with the metal cover 41 of the smokeless tobacco container to admit removal and installation of the smokeless tobacco container 40 therein and admit access to the metal cover 41 of the smokeless tobacco container for accessing the tobacco stored therein. The tight skin is released to snap back to conform to and grip the metal cover 41 of the smokeless tobacco container 40.

The covering skin 20 comprises a molded body which may have a top material 25 and a different bottom material 26. The top material 25 comprises a highly elastic high friction clinging rubberized material to seal around the metal top 41 of the smokeless tobacco container 40 and the bottom material 26 may comprise a waterproof material having a smooth low friction outer portion so that the present invention slides easily into and out of pockets and other storage spaces.

The covering skin 20 preferably comprises low profile silicone like molded material having an elastic characteristic to form fit the smokeless tobacco container 40.

The top portion 25 of the covering skin comprises at least one circular sealing ring 24 molded into the covering skin to conform to and seal against a top rim edge 44 of the metal cover 41 of the smokeless tobacco container 40, as shown in FIG. 3.

Any of a wide variety of colors, designs, logos, names, images may be molded into the covering skin or imprinted thereon.

In use, the present invention provides a form fitting removable skin cover for smokeless tobacco containers which has a watertight bottom portion around the bottom cardboard area of the smokeless tobacco container and a skin tight form fitting top portion to form a watertight seal with the metal top of the smokeless tobacco container to prevent air, liquid, and moisture from seeping down onto the cardboard bottom of the smokeless tobacco container thereby preventing spoiling of the tobacco in the container from air or moisture exposure through the bottom cardboard portion of the smokeless tobacco container.

The center opening in the top fits tightly against the top of the can to form a seal, but is easily lifted and stretched to install or remove a smokeless tobacco container and to gain access to the tobacco by opening the metal top of the smokeless tobacco container.

The surfaces of the present invention provide for a wide variety of options including color, design, custom logos/names, images, and sports logos or other licensed images.

The close fitting skin housing on the top and the molded circular sealing surfaces of the cover skin seal around the circular disconformities of the metal cover the top and the side of the skin housing of the present invention mates with the shape of the smokeless tobacco can cover to form a watertight seal with the metal cover of the smokeless tobacco can. The form fitting thin elasticized housing grips the tobacco can with a form fit to seal in the bottom portion of the smokeless tobacco can to prevent water from contacting the bottom of the can and ruining the tobacco and to preserve the tobacco and prolong the useful life of the tobacco and maintain the freshness.

A smooth surface at least on the bottom of the housing skin enables the skin covered smokeless tobacco can to slip in and out of a pocket or carrying bag easily.

The round hole in the top of the housing skin and the highly flexible skin enable the skin to be grasped and stretched back to install the smokeless tobacco can in the skin housing or remove it therefrom and to allow easy lifting or removal of the smokeless tobacco can cover or removal of the skin from the can for access to the tobacco inside. The close fitting skin housing on the top of the metal can cover and the circular sealing ring prevent liquids from entering through the top skin housing opening to preserve the bottom of the can by providing a waterproof covering and seal.

It is understood that the preceding description is given merely by way of illustration and not in limitation of the invention and that various modifications may be made thereto without departing from the spirit of the invention as claimed.

What is claimed is:

1. A waterproof smokeless tobacco container combination comprising:

a. a cylindrical container comprising a base having a round floor attached to a cylindrical side wall, and a removable round metal cap for engagement with said side wall, said cap having an annular rim on a top thereof;

b. a deformable molded body for removably encasing said container, said body comprising a rounded floor having a circumferential edge, a cylindrical side wall perpendicularly attached to the edge of said floor, and a partial upper wall perpendicularly attached to said side wall, said partial upper wall including a molded sealing ring and having a stretchable central opening therein, wherein said upper wall extends over and grips the metal cap of said container and said sealing ring engages said annular rim to provide a waterproof seal for said container.

2. The combination of claim 1 wherein the molded body further comprises a top portion and a bottom portion, the top portion comprising a highly elastic high friction clinging rubberized material that seals around the metal cap of the cylindrical container, and the bottom portion comprising a different material having a smooth low friction outer surface that slides easily into and out of a user's pocket or other storage space.

3. The combination of claim 1 wherein the molded body comprises a low profile silicone like molded material having an elastic characteristic to form fit the cylindrical container.

4. The combination device of claim 1 wherein any of a wide variety of colors, designs, logos, names, images are molded into the body.

5. The combination of claim 1 wherein any of a wide variety of colors, designs, logos, names, images are imprinted on the molded body.

6. In combination, a smokeless tobacco container and cover therefor comprising:

a. a cylindrical container comprising a base having a round floor attached to a cylindrical side wall with an open top, and a removable round metal cap engaged with said side wall at said top;

b. a rubberized flexible skin for removably encasing said base and a portion of said cap, said skin comprising a molded body having a round base, a cylindrical side wall and a partial upper wall, said partial upper wall having a central opening therein, wherein said upper wall extends over and grips the metal cap of said container to provide a waterproof seal for said container.

7. The combination of claim 6 wherein said cap further comprises an annular rim, and said skin further comprises a sealing ring molded into said upper wall for engagement with said annular rim.

8. A process for preventing moisture from entering a smokeless tobacco container comprising the steps of:

a. closing a container for smokeless tobacco by engaging a metal cap having an annular rim with a cylindrical bottom section of said container;

b. stretching an upper central opening in a deformable molded body in order to receive said container, said body comprising a round base, a cylindrical side wall and a partial upper wall, said partial upper wall including said upper central opening and a molded sealing ring; and c. inserting the container through said stretched upper opening such that said body clings to said container, said upper wall extends over and grips the metal cap of said container, and said sealing ring engages said annular rim to provide a waterproof seal for said container.

* * * * *